United States Patent [19]

Lew et al.

[11] Patent Number: 4,598,793

[45] Date of Patent: Jul. 8, 1986

[54] SKY-RIDE EMERGENCY ESCAPE SYSTEM

[76] Inventors: Hyok S. Lew; Hyon S. Lew; Yon K. Lew, all of 7890 Oak St., Arvada, Colo. 80005

[21] Appl. No.: 676,400

[22] Filed: Nov. 29, 1984

[51] Int. Cl.[4] ..... A62B 1/08

[52] U.S. Cl. ..... 182/42; 182/5; 182/72; 182/236

[58] Field of Search ..... 182/42, 4–7, 182/231, 75, 236, 240, 71, 72, 190–193, 43, 72; 188/65.1–65.5

[56] References Cited

U.S. PATENT DOCUMENTS

| | | | |
|---|---|---|---|
| 957,589 | 5/1910 | Welch | 188/65.4 |
| 1,113,369 | 10/1914 | Olson | 182/5 |
| 3,210,050 | 10/1965 | Harmony | 188/65.4 |
| 3,869,021 | 3/1975 | Sutherland | 182/7 |
| 4,476,956 | 10/1984 | Eger | 188/65.5 |

FOREIGN PATENT DOCUMENTS

| | | | |
|---|---|---|---|
| 2316975 | 11/1977 | France | 182/5 |

*Primary Examiner*—Reinaldo P. Machado

[57] ABSTRACT

This invention relates to an emergency escape system for escape from elevated structures such as sky-scrapers, high-rise apartment or office buildings, etc., which system enables one to lower oneself from any level of a high-rise building to ground level all by oneself without requiring any help from rescue crews wherein, with the minimum amount of physical effort, the descending motion and speed is completely controlled by the descending person. The sky-ride emergency system comprises a closed loop of rope or cable wound on a friction drum over a number of complete laps in a substantially tight relationship. The cylindrical surface of the friction drum nonrotatably secured to an elevated level has a high friction coefficient. The closed loop of rope depending from the friction drum includes at least one securing means such as a hook or ring affixed to the rope. The lower extremity of the closed loop of rope depending from the friction drum reaches down to a lower level such as ground level. A rope guide means slidably guides and confines the portion of rope wound on the friction drum. The frictional grip of the rope on the friction drum resulting from a pull on one rope member depending from the friction drum by the weight of an evacuee secured to said one rope member can be altered to a great extent by exerting a weak pull of varying magnitude on the other rope member depending from the friction drum. As a consequence, an evacuee wearing a harness secured to one of two rope members depending from the friction drum is able to suspended oneself in midair or lower oneself by controlling the small amount of pull exerted on the other of two rope members depending from the friction drum by the evacuee.

12 Claims, 16 Drawing Figures

SKY-RIDE EMERGENCY ESCAPE SYSTEM

BACKGROUND OF THE INVENTION

It is a great irony that sophisticated modern technology has failed to provide a simple and efficient device for escaping from a burning high-rise building. Indeed, it is a serious contradiction that a great civilization that is able to send men to the moon and bring them back safely, has been unable to address a solution to the danger that confronts millions of people living or working in high-rise buildings. Wittingly or unwittingly, millions of people living or working in high-rise buildings are risking their lives, for there is no safe and efficient escape means from a towering inferno once the stairways and elevators are blocked off by fire or smoke. It is quite logical to compare high-rise apartments and office buildings to an ocean liner without life boats.

The primary object of the present invention is to provide an emergency escape device for escaping from a burning high-rise building that is self-sufficient and self-contained.

Another object of the present invention is to provide an emergency escape system that is operable by the evacuee himself or herself.

A further object of the present invention is to provide an emergency escape device that is usable by many evacuees in turn during one emergency and reusable during other emergencies without requiring any servicing.

Yet another object of the present invention is to provide an emergency escape device that provides a wide range of descending distance and speed.

Yet a further object of the present invention is to provide an emergency escape device that is compatible with people of all ages.

Still another object of the present invention is to provide an emergency escape device from an elevated structure that is extremely light-weight and compact so that it can be stored in a closet, cabinet, drawer, etc., and can be easily deployed in an emergency.

Still a further object of the present invention is to provide an emergency escape device that requires the minimum amount accessory affixed to the building structure for securing the emergency escape device.

Additionally another object of the present invention is to provide an emergency escape device that is inexpensive; whereby, every family and person living in a high-rise apartment affords to have one.

Additionally a further object of the present invention is to provide a portable transporting device for ascending and descending that is usable by mountain climbers, spelunkers, emergency rescue crews, military personel, etc.

These and other objects of the present invention will become clear as the description thereof proceeds.

BRIEF DESCRIPTION OF FIGURES

The present invention may be described with a greater clarity and specificity by referring to the following figures.

DESCRIPTION OF THE ILLUSTRATED EMBODIMENTS

Figure 1:
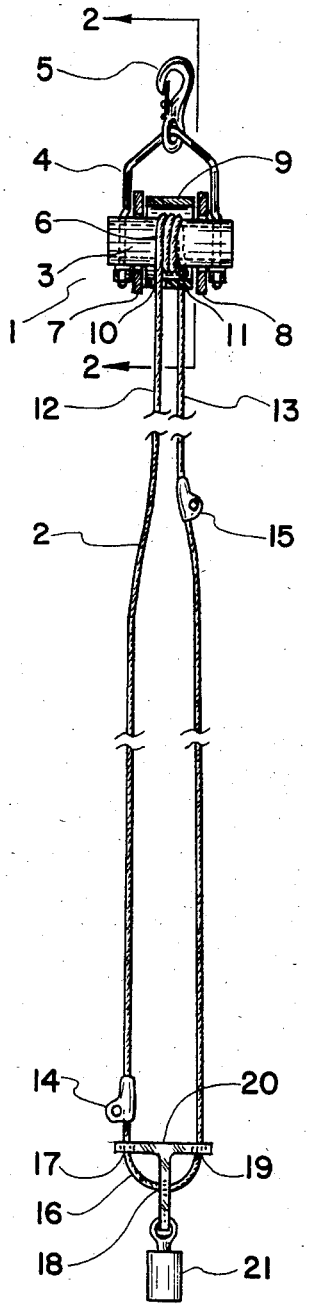
FIG. 1 illustrates a sky-ride emergency escape system constructed in accordance with the principles of the present invention.

In FIG. 1 there is illustrated a sky-ride emergency escape device constructed in accordance with the principles of the present invention, which comprises a two-way frictionally controlled rope release device 1 and a closed loop of rope or cable 2 depending therefrom. The two-way frictionally controlled rope release device 1 comprises a friction drum of a substantially circular cylindrical geometry 3 nonrotatably supported by a yoke or U-bolt 4 which includes a securing means 5 such as a snap-hook or clasp. A portion 6 of the closed loop of rope 2 is wound on the friction drum 3 over a number of complete laps intermediate a pair of retaining washers 7 and 8 which are rotatably or nonrotatably engaged by the friction drum 3. A rope guide sleeve 9 including a pair of rope guide holes 10 and 11 is disposed around the friction drum 3 in a substantially coaxial relationship providing a shell space intermediate the friction drum 3 and the rope guide sleeve 9 wherein the portion 6 of the closed loop of rope 2 is slidably confined. The portions 12 and 13 of the closed loop of rope 2 respectively extending from the portion 6 wound on the friction drum 3 slidably engage and extend through the rope guide holes 10 and 11, respectively. Two portions 12 and 13 of the closed loop of rope 2 depending from the friction drum 3 include a pair of securing means 14 and 15, respectively, which may be closed rings or snap-hooks. The pair of securing means 14 and 15 are positioned in such a way that one of two securing means move close to the friction drum 3 when the other of two securing means moves close to the lower extremity 16 of the closed loop of rope 2 depending from the friction drum 3. The lower extremity 16 of the closed loop of rope is routed through a series of oversized holes 17, 18 and 19 respectively disposed through the extremities of a T-shaped member 20 including a weight 21 suspended therefrom.

Figure 2:
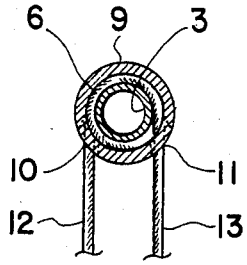
FIG. 2 illustrates a cross section of the embodiment shown in FIG. 1 taken along a plane 2—2 as shown in FIG. 1 wherein the operating principle of a two-way frictionally controlled rope release device is shown.

In FIG. 2 there is illustrated a cross section of the two-way frictionally controlled rope release device 1 shown in FIG. 1 taken along a plane 2—2 as shown in FIG. 1. The friction drum 3 and the rope guide sleeve 9 coaxially disposed to one another provides a shell space therebetween wherein the portion 6 of the closed loop of rope 2 wound on the friction drum 3 is slidably confined. The portion 12 of the closed loop of rope 2 extending from the portion 6 thereof slidably engages and extends through the rope guide hole 10 included in the rope guide sleeve 9 and depends from the friction drum 3. The portion 13 of the closed loop of rope 2 extending from the portion 6 thereof slidably engages and extends through the rope guide hole 11 included in the rope guide sleeve 9 and depends from the friction drum 3.

Figure 3:
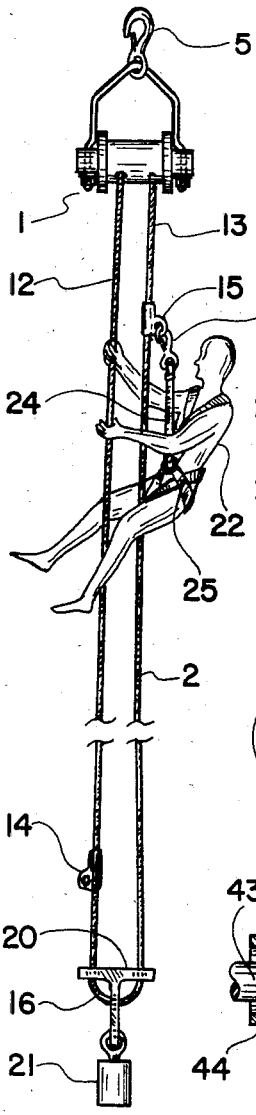
FIG. 3 illustrates the operating principles of the sky-ride emergency escape system illustrated in FIG. 1.

In FIG. 3 there is illustrated the operating principles of the sky-ride emergency escape device shown in FIG. 1. The two-way frictionally controlled rope release device 1 is firmly secured to an elevated structure by means of the securing means 5 such as a snap-hook that is anchored to a suitable structure affixed to the elevated structure from which an evacuee 22 is attempting to escape. Firstly by pulling only one of two portions 12 and 13 of the closed loop of rope 2 depending from the two-way frictionally controlled rope release device 1, the evacuee brings one of two securing means 14 and 15 attached to the closed loop of rope 2 to a level where the evacuee 22 is able to clasp the clasp means 23 attached to the extremity of a tether member 24 extending from the harness 25 that is secured around the torso, thighs and shoulders of the evacuee onto the securing means 14 or 15. Upon securing the harness 25 worn by the evacuee 22 to one of the securing means 15 affixed to the portion 13 of the closed loop of rope 2, the evacuee 22 grabs the portion 12 of the closed loop of rope 2 and steps off from the elevated structure. The weight of the evacuee suspended by the rope member 13 creates a large amount of tension on the portion 6 of the closed loop of rope 2 wound on the friction drum 3 and results in a powerful frictional grip on the friction drum 3 by the portion 6 of the closed loop of rope 2. The magnitude of the frictional grip of the rope member 6 on the friction drum 3 becomes large enough to suspend the evacuee 22 in midair motionlessly when the evacuee 22 exerts a small amount of pull on the rope member 12 that is equal to only a small percent of the body weight of the evacuee. The magnitude of the frictional grip on the friction drum 3 by the closed loop of rope 2 can be controlled to a great extent by controlling the small amount of pull on the rope member 12. This phenomenon is similar to the triode electron tube wherein a small change in the controlling grid potential drastically amplifies the change in the electric current flow from the cathode to the anode. By executing the hand-over-hand movement in grabbing the rope member 12 or by continuously releasing the rope member 12 under a friction provided by a gentle grasp on the rope member 12, the evacuee 22 lowers himself to a lower level such as ground level at a speed that is suitable to the operating environment and to the physical capability of the evacuee. If the distance between the two-way frictionally controlled rope release device 1 and the lower extremity 16 of the closed loop of rope 2 depending from the friction drum 3 is substantially matched to the height of the elevated structure from which the evacuee 22 is escaping, the securing means 14 becomes automatically positioned for the next evacuee when the evacuee 22 lands on ground level and diconnects the clasp means 23 from the securing means 15. The next evacuee secures the harness worn by him or her to the securing means 14 affixed to the rope member 12 and grabs the rope member 13 whereupon he or she steps off from the elevated structure and lowers oneself to ground level. This escape procedure is repeated untill every evacuee is lowered to ground level. It is readily realized that a person at ground level can control the descending speed of an evacuee by manipulating the lower extremity 16 of the closed loop of rope 2 depending from the friction drum 3 wherein the T-shaped member 20 may be used to control the tension on the rope member that does not suspend the evacuee. It is obvious that the descending speed of an evacuee can be also controlled by a person at an elevated level who has access to the rope member that does not suspend the evacuee. This mode of operation enables one to lower people with less than full physical capability such as the babies, young children, old people, invalids, etc. by using the sky-ride emergency escape system of the present invention. If the length of the closed loop of rope 2 is not matched to the height of evacuation, one may bring up either one of two securing means 14 and 15 by pulling an appropriate rope member of two rope members 12 and 13. The closed loop of rope 2 can be easily put into an looping movement by pulling one of two rope members 12 and 13 when neither of two rope members suspends a weight. It should be understood that the closed loop of rope 2 may include only one securing means instead of two securing means 14 and 15, and still be able to bring down many evacuees one after other. It should be also understood that it is not necessary that the rope members 12 and 13 form a closed loop. The rope members 12 and 13 may constitute single rope with two extremities respectively including a pair of stop means which prevent the rope from being pulled through the two-way frictionall controlled rope release device 1. The weight 21 suspended from the T-shaped member 20 prevents the rope members 12 and 13 from tangling and twisting about one another. It should be understood that one of two securing means 14 and 15, and the combination of the T-shaped member 20 and the weight 21 are optional elements providing a smoother and faster operation of the sky-ride emergency escape system, while those elements can be omitted if a specific working environment dictates the removal thereof.

Figure 4:
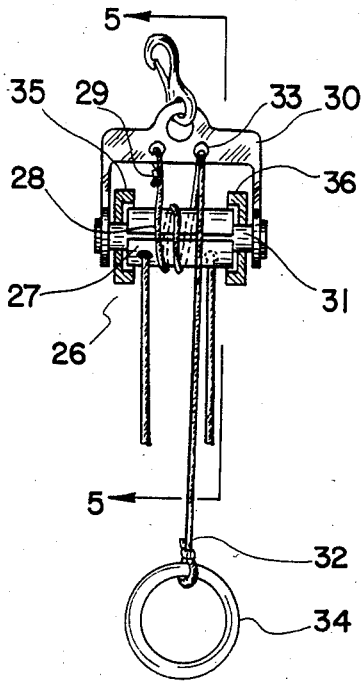
FIG. 4 illustrates another embodiment of the two-way frictionally controlled rope release device including an additional braking means.

In FIG. 4 there is illustrated another embodiment of the two-way frictionally controlled rope release device 26 that has essentially the same construction and the operating principles as the embodiment 1 shown in FIGS. 1 and 2. The embodiment 26 has an additional feature that enables a person at an elevated level to control the descending speed of an evacuee. The braking means operable by a third person at an elevated level comprises a rope guide sleeve 27 that is split into a plurality of lengthwise segments constituting a collapsible hollow cylinder, and a brake rope 28 wound on the segmented rope guide sleeve 27 over a number of complete laps wherein one extremity 29 of the brake rope 28 is immovably anchored to the yoke structure 30 nonrotatably supporting the friction drum 31 and the other extremity 32 of the brake rope 28 slidably engaging and extending through a guide hole 33 diposed through the yoke structure 30 icludes a handle ring 34. The segmented rope guide sleeve 27 is retained in position by a pair of flanged washers 35 and 36.

Figure 5:
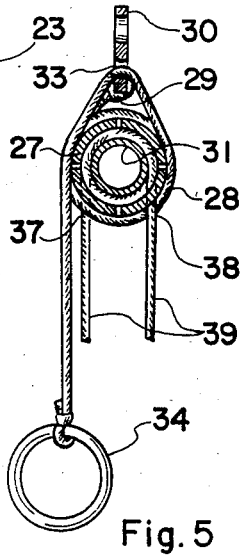
FIG. 5 illustrates a cross section of the device shown in FIG. 4 taken along a plane 5–5 as shown in FIG. 4.

In FIG. 5 there is illustrated a cross section of the two-way frictionally controlled rope release device 26 shown in FIG. 4 taken along a plane 5–5 as shown in FIG. 4. The split rope guide sleeve 27 includes a pair of rope guide holes 37 and 38 which slidably guide the closed loop of rope 39 into the shell cavity intermediate the friction drum 31 and the split rope guide sleeve 27 wherein a portion of the closed loop of rope 39 is wound on the friction drum 31 over a number of complete laps. The brake rope 28 is wound on the split rope guide sleeve 27 over a number of complete laps. As explained in conjunction with FIG. 3, the descending speed of an evacuee suspended by one rope member of the closed loop of rope 39 is controlled by the frictional force between the friction drum 31 and the closed loop of rope 39 wound thereon that is controlled by a small amount of pull exerted on the other rope member of the closed loop of rope 39 by the evacuee or a third person having an access to said the other rope member. When the brake rope 28 is not under tension, there is no significant amount of friction between the split rope guide sleeve 27 and the closed loop of rope 39 wound on the friction drum 31 and, consequently, the rope release device 26 operates in the same way as the rope release device 1 shown in FIG. 1. When the ring handle 34 is pulled by a person at an elevated level, the tension on the brake rope 28 squeezes the split rope guide sleeve 27 against the rope member wound on the friction drum 31 and, consequently, an additional braking on the descending speed of an evacuee is provided. Therefore, the descending speed of an evacuee can be controlled either by the evacuee grabbing one of two rope members that does not suspend the evacuee or by a third person at an elevated level pulling the brake rope handle ring 34. Of course, another third person at ground level can also control the descending speed of an evacuee by grabbing one of two rope members that does not carry the weight of the evacuee.

Figure 6:
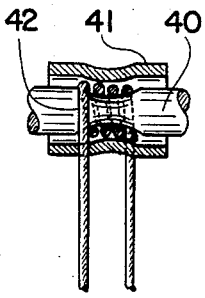
FIG. 6 illustrates a further embodiment of the two-way frictionally controlled rope release device.

In FIG. 6 there is illustrated a combination of a necked-down friction drum 40 and a necked rope guide sleeve 41, which combination tends to congregate the individual laps of the rope member 42 wound on the friction drum 40.

Figure 7:
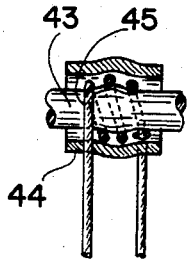
FIG. 7 illustrates yet another embodiment of the two-way frictionally controlled rope release device.

In FIG. 7 there is illustrated another combination of a friction drum 43 having a bulging-out section and a rope guide sleeve 44 matched to the friction drum 43. This combination tends to spread out the individual laps of the rope member 45 wounded on the friction drum 43.

Figure 8:
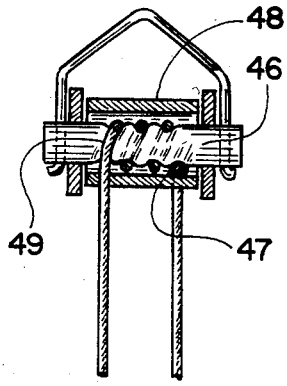
FIG. 8 illustrates yet a further embodiment of the two-way frictionally controlled rope release device.

In FIG. 8 there is illustrated a further combination of a friction drum 46 including a helical groove 47 and a straight hollow cylinder rope guide sleeve 48. This combination provides an advantage in terms of reduced rope wear as the helical groove 47 guides the rope member 49 wound on the friction drum 46.

Figure 9:
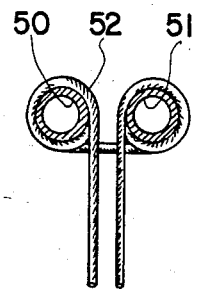
FIG. 9 illustrates an embodiment of two-way frictionally controlled rope release device employing a double friction drum.

In FIG. 9 there is illustrated a cross section of an embodiment of the two-way frictionally controlled rope release device that employs a double friction drums 50 and 51 wherein the rope member 52 is wound on the first friction drum 50, crossed over to and wounded on the second friction drum 51.

Figure 10:
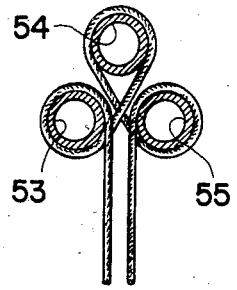
FIG. 10 illustrates an embodiment of two-way frictionally controlled rope release device employing a triple friction drum.

In FIG. 10 there is illustrated a cross section of the two-way frictionally controlled rope release device including a triple friction drums 53, 54 and 55.

Figure 11:
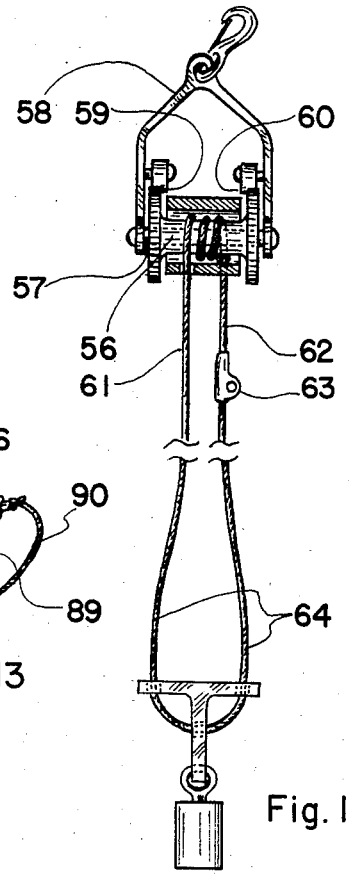
FIG. 11 illustrates a sky-ride emergency escape device employing a one-way frictionally controlled rope release device.

In FIG. 11 there is illustrated another sky-ride emergency escape system that has essentially the same elements and construction as the embodiment shown in FIG. 1 with one exception being that the frictionally controlled rope release device included therein provided frictional braking in one-way only. The friction drum 56 includes a pair of ratchet mechanisms 59 and 60 and, consequently, the friction drum 56 can be rotated freely relative to the yoke structure 58 in one direction while it is not rotatable relative to the yoke structure 58 in the other direction. The rope member 61 can be pulled down rapidly to raise the securing menas 63 attached to the rope member 62 rapidly, as the looping movement of the closed loop of rope 64 in said direction is enhanced by the free rotation of the friction drum 56 relative to the supporting shaft 57. The looping movement of the closed loop of rope 64 that lowers the securing means 63 is subjected to the same frictional resistance as that described in conjunction with FIG. 3. The sky-ride emergency escape system shown in FIG. 11 operates in the same principle as the embodiment shown in FIG. 3 with one exception being that only the rope member 62 with the securing means 63 is used to suspend an evacuee. After each evacuation, the securing means 63 is raised back for the next evacuee by pulling down the rope member 61, which is done by the next evacuee or a person at ground level who may be an evacuee who has just come down.

Figure 12:
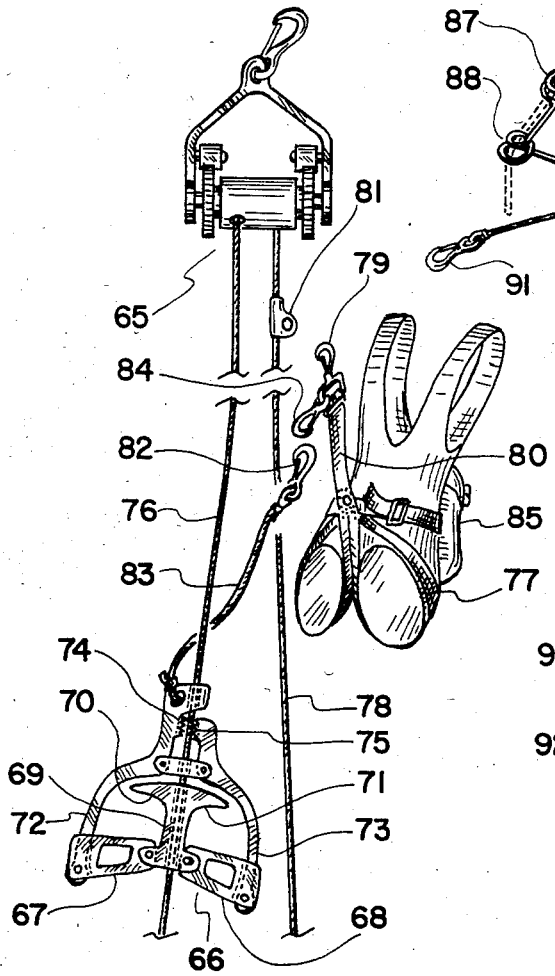
FIG. 12 illustrates a sky-ride system with descending as well as ascending capability.

In FIG. 12 there is illustrated a sky-ride emergency system 65 constructed in the same way as the embodiment shown in FIG. 11 wherein a friction drum with ratchet mechanism is employed. With the incorporation of the stirrup assembly 66, the sky-ride emergency escape system 65 enables one to raise oneself from a lower level to an upper level, and to lower oneself from an upper level to lower level. Of course the lowering operation has been already described in conjunction with FIGS. 3 and 11 and, consequently, it does not need any further explanation. The stirrup assembly 67 includes a pair of foot-rests 67 and 68 pivotably connected to a rope guide 69 having a pair of foot-catches 70 and 71, which combination functions as a toggle joint acting on a pair of the stirrup frames 72 and 73 built into a rope arrest that includes a set of clamping jaws 74 and 75. When the pair of foot-rests 67 and 68 are pressed down, the clamping jaws 74 and 75 shut and grab the rope member 76 slidably guiding the stirrup assembly 66 and, consequently, the stirrup assembly 66 locks on the rope member 76. When the pair of foot-rest 67 and 68 are lifted up by a pair of feet being lifted which catch the foot-catches 70 and 71, the clamping jaws 74 and 75 open and, consequently, the stirrup assembly is allowed to slide along the rope member 76. A person wearing the harness 77 suspends oneself from the rope member 78 by clasping the clasping means 79 affixed to the free-end of a tether member 80 extending from the harness 77 onto the securing means 81 attached to the rope member 78 and lowers oneself in the same manner as explained in conjunction with FIG. 3. When a person wearing the harness 77 attached to the securing means 81 of the rope member 78 wants to raise oneself from a lower level to an upper level, one clasps the snap-hook 82 attached to a tether line 83 extending from the stirrup assembly 66 onto the ring 84 attached to the tether member 80 extending from the harness. Firstly, one places both feet in the stirrup assembly 66 and lifts it about a foot whereupon one stands up with both feet placed on the foot-rests 67 and 68 included in the stirrup assembly 66, which action will pull down the rope member 76 about a foot and raises up the rope member 78 about a foot that results in raising the person wearing the harness about a foot, wherein the lowering movement of the rope member 76 and raising movement of the rope member 78 is facilitated by the free-wheeling rotation of the friction drum equipped with rachet mechanism that is included in the one-way frictionally controlled rope release device 85. Secondly, one grabs the rope member 76 with both hands and pulls it down with a small force equal to a small percent of the body weight, which action prevents any further movement of the rope members 76 and 78. One pulls up the sirrup assembly 66 again by lifting up both feet and stands up on both feet again, resulting in raising oneself another foot or so. By repeating the aforementioned precedure over and over, one is able to raise oneself at a moderately fast speed virtually effortlessly. The pocket 85 attached to the harness 77 may be used to carry a baby or young child or other belongings.

Figure 13:
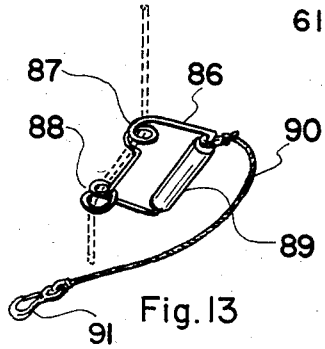
FIG. 13 illustrates a hand-held device for controlling descending speed that is usable in conjunction with the sky-ride emergency escape devices shown in FIGS. 1, 11 and 12.

In FIG. 13 there is shown a device for controlling the descending speed. The device 85 includes a steel rod 86 bent in a rectangular shape that includes a pair of coil forms 87 and 88 wound in two opposite directions, respectively, and a handle bar 89. A tether line 90 with a snap-hook 91 attached to one extremity is secured to the handle bar 89. A person wearing the harness descending on a sky-ride emergency escape system such as that shown in FIG. 12 hooks up the snap-hook 91 onto the ring 84 attached to the harness and engages the coils 87 and 88 around the rope member 76, as shown in broken lines in FIG. 13. By tilting the handle bar 89 to various angles with respect to the rope member 76, one can control the pull on the rope member 76 and, consequently, is able to control one's descending speed. Upon the completion of descending, one may disengage the descending speed control device 85 from the rope member 76.

Figure 14:
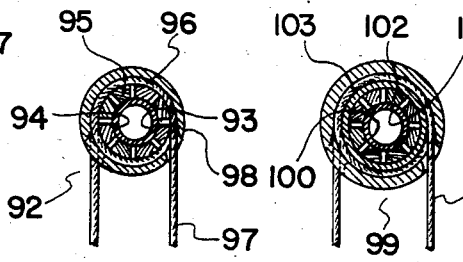
FIG. 14 illustrates an embodiment of the frictionally controlled rope release device equipped with a rope-saver friction drum.

In FIG. 14 there is illustrated a cross section of an embodiment of the frictionally controlled rope release device equipped with a rope-saver friction drum 93 that includes a cylindrical member 94 fitted within a brake liner sleeve 95. The squeezable brake lining 95 is a squeezable hollow cylinder of a sizable wall thckness, which may be a hollow cylinder split into a plurality of lengthwise members which are physically separated from each other or bonded together by a resilient filler filling the gaps therebetween. The rope member 96 constituting the closed loop of rope 97 is wound on the outer surface of the squeezable brake lining 95 over a number of complete laps wherein the rope member 96 wound on the friction drum assembly 93 is packaged within a rope guide sleeve 98 having the same construction as that described in conjunction with FIGS. 1 and 2. In this arrangement, there is little slipping motion between the outer surface of the squeezable brake lining 95 and the rope member 96 wound thereon, as all the frictionally controlled slipping motion takes place at the interface between the inner surface of the squeezable brake lining 95 and the outer surface of the inner cylindrical member. The tension on the rope member 96 squeezes the brake lining 95 against the inner cylindrical member 94 and provides the necessary frictional braking on the relative rotating motion between the squeezable brake lining 95 and the inner cylindrical member 94. By virtue of the fact that the outer cylindrical surface area is greater than the inner cylindrical surface area of the brake liner sleeve 95, the slipping motion takes place exclusively at the interface between the inner surface of the squeezable brake lining 95 and the outer surface of the inner cylindrical member 94. Since the rope member 96 is not experiencing any slipping motion itself, the wear on the rope member 96 is virtually eliminated. In order to further insure that there is no slipping motion between the rope member 96 and the squeezable brake lining 95, one may employ a measure that provides a greater friction coefficient for the outer cylindrical squeezable brake lining 95 compared with its inner cylindrical surface, which measure may include a series of lengthwise indentations disposed on the outer cylindrical surface of the squeezable brake lining 95.

Figure 15:
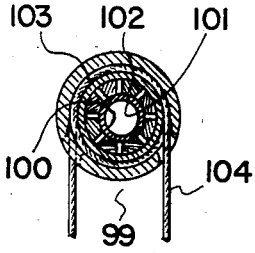
FIG. 15 illustrates an embodiment of the frictionally controlled rope release device equipped with a waterproof rope-saver friction drum.

In FIG. 15, there is illustrated a cross section of another embodiment of the frictionally controlled rope release device 99 employing a rope-saver friction drum 100. The embodiment 99 is constructed essentially in the same way as the embodiment 92 of FIG. 14 with one exception being that the friction drum assembly 100 including the inner cylindrical 101 and the squeezable brake lining 102 is sealed within an elastic tubular cylinder 103 made of rubber or rubber-like material in a waterproof quality. The rope member of the closed loop of rope 104 is wound on outer surface of the elastic tubular cylinder 103. The slipping motion under friction takes place at an interface between the inner cylindrical surface of the squeezable brake lining 102 and the outer cylindrical surface of the inner cylindrical member 101, which elements are sealed inside of the elastic tubular cylinder 103 in a waterproof fashion and, consequently, the performance of the frictionally controlled rope release device 99 is not compromised by the physical state of the rope member 104 that can be altered by the moisture, water, dust, etc. existing in the working environment of the device.

Figure 16:
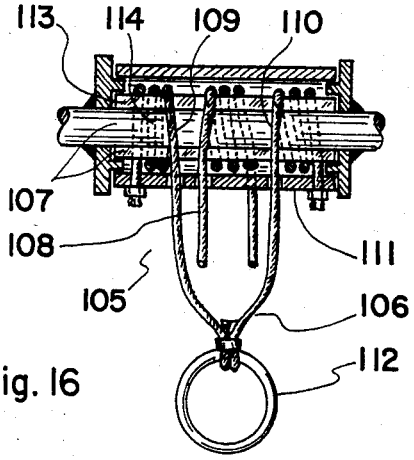
FIG. 16 illustrates an embodiment of the frictionally controlled rope release device equipped with a rope-saver friction drum wherein an additional braking means is included.

In FIG. 16 there is illustrated a cross section of the frictionally controlled rope release device 105 that includes additional means 106 for controlling the descending speed of an evacuee. The embodiment 105 employs the same friction drum assembly as the device shown in either FIGS. 14 or 15 on which friction drum assembly 107 the closed loop of rope 108 for lowering an evacuee is wound. A pair of brake ropes 109 and 110 with the first extremities secured to the rope guide sleeve 111 and the other extremities connected to a handle ring 112 are wound on the braking drum assembly 107. The tension on the brake ropes 109 and 110 created by a pull on the handle ring 112 squeezes the brake liner sleeve 113 against the inner friction drum 114 and, consequently, provides a further menas for controlling the descending speed of an evacuee that is operable by a person at an upper level having an access to the handle ring 112, which descending speed control means may be used as a substitution of or in complement with the descending speed control exercised by an evacuee himself or herself as explained in conjunction with FIG. 3. It should be understood that the rope employed as the closed loop of rope lowering evacuees or as the brake rope included in the additional descending speed control means may be metalic wire ropes, cables, twisted or braided ropes of natural or synthetic fibers, or link chains or other types of chains made of metalic or nonmetalic material. In generic term, the ropes employed in the construction of the sky-ride emergency escape system will be called "cord". It is obvious that the device for lowering and raising a person taught by the present invention can be used by the mountain climbers, cave explorers, rescue crews, construction crews, etc.

While the principles of the present invention have now been made clear by the illustrative embodiments, it will be immediately obvious to those skilled in the art many modifications of the arrangements, elements, proportion, structures and materials, which are particularly adapted to the specific working environments and operating conditions in the practice of the invention without departing from those principles.

We claim:

1. A device for lowering a person or object from a higher elevation to a lower elevation, said device comprising in combination:

(a) a cylindrical member nonrotatably secured to a supporting structure including a means for securing said supporting structure to an elevated structure;

(b) a squeezable brake lining of a substantial wall thickness enveloping the cylindrical surface of said cylindrical member in a rotatable relationship;

(c) a cord member wound on said squeezable brake lining over at least one and one half complete laps wherein one portion of said cord member extends from one side of the cylindrical surface of said squeezable brake lining and the other portion of said cord member extends from the other side of the cylindrical surface of said squeezable brake lining enveloping said cylindrical member;

(d) a cord guide means for guiding said cord member wound on said squeezable brake lining, wherein said cord guide means enhances smooth looping movement of said cord member wound on said squeezable brake lining creating rotation of said squeezable brake lining; and (e) at least one securing means affixed to said one portion of said cord member for securing a harness;

whereby, a person or persons wearing a harness secured to said securing means affixed to said one portion of said cord member can remain suspended in midair or lower oneself at a safe speed by exerting a small amount of pull on said the other portion of said cord member as said small amount of pull on said the other portion of said cord member produces a tension on said cord member that sequeezes said squeezable brake lining on said cylindrical member, providing a frictional braking hindering rotating movements of said squeezable brake lining relative to said cylindrical member and, thus, providing braking on looping movement of said cord member resulting from said rotating movements of said squeezable brake lining relative to said cylindrical member.

2. The combination as set forth in claim 1 wherein said combination includes a harness securable on a person or object, said harness including a means for removably securing said harness to said at least one securing means affixed to said one portion of said cord member.

3. The combination as set forth in claim 2 wherein extremity of said one portion of said cord member is connected to extremity of said the other portion of said cord member, wherein said cord member forms a closed loop of cord depending from said squeezable brake lining enveloping said cylindrical member.

4. The combination as set forth in claim 3 wherein a weight is attached to the extremity of said closed loop of said cord member depending from said squeezable brake lining in a slidable relationship.

5. The combination as set forth in claim 1 wherein extremity of said one portion of said cord member is connected to extremity of said the other portion of said cord member, wherein said cord member forms a closed loop of cord depending from said squeezable brake lining enveloping said cylindrical member.

6. The combination as set forth in claim 5 wherein a weight is attached to the extremity of said closed loop of said cord member depending from said squeezable brake lining in a slidable relationship.

7. The combination as set forth in claim 1 wherein at least another securing means for securing a harness is affixed to said the other portion of said cord member at a position wherein one of said at least one and another securing means for securing harness is positioned at said higher elevation when the other of said at least one and another securing means for securing harness is positioned at said lower elevation.

8. The combination as set forth in claim 7 wherein extremity of said one portion of said cord member is connected to extremity of said the other portion of said cord member, wherein said cord member forms a closed loop of cord depending from said squeezable brake lining enveloping said cylindrical member.

9. The combination as set forth in claim 8 wherein a weight is attached to the extremity of said closed loop of said cord member depending from said squeezable brake lining in a slidable relationship.

10. The combination as set forth in claim 7 wherein said combination includes at least one harness securable on a person or object, said at least one harness including a means for removably securing said at least one harness to one of said at least one and another securing means affixed to said cord member.

11. The combination as set forth in claim 10 wherein extremity of said one portion of said cord member is connected to extremity of said the other portion of said cord member, wherein said cord member forms a closed loop of cord depending from said squeezable brake lining enveloping said cylindrical member.

12. The combination as set forth in claim 11 wherein a weight is attached to the extremity of said closed loop of said cord member depending from said squeezable brake lining in a slidable relationship.

* * * * *